US011225798B1

(12) United States Patent
Moeller

(10) Patent No.: US 11,225,798 B1
(45) Date of Patent: Jan. 18, 2022

(54) DECORATIVE SHOE FOR BALUSTERS

(71) Applicant: David W Moeller, Flowery Branch, GA (US)

(72) Inventor: David W Moeller, Flowery Branch, GA (US)

( * ) Notice: Subject to any disclaimer, the term of this patent is extended or adjusted under 35 U.S.C. 154(b) by 928 days.

(21) Appl. No.: 15/732,384

(22) Filed: Nov. 2, 2017

Related U.S. Application Data

(60) Provisional application No. 62/496,952, filed on Nov. 3, 2016.

(51) Int. Cl.
*E04F 11/18* (2006.01)

(52) U.S. Cl.
CPC ..... *E04F 11/1814* (2013.01); *E04F 11/1846* (2013.01); *E04F 2011/1827* (2013.01)

(58) Field of Classification Search
CPC ..... E04F 11/1814; E04F 11/1846; E04F 2011/1827; E04F 11/1834; E04F 11/1842; E04H 17/1439; E04H 12/2292; E01F 15/0469
See application file for complete search history.

(56) References Cited

U.S. PATENT DOCUMENTS 3,305,990 A * 2/1967 Hageby ..... E04H 12/22 52/298
4,102,529 A 7/1978 Neblung
4,403,767 A 9/1983 Basey
5,876,021 A 3/1999 Spence
6,256,961 B1 * 7/2001 Byrnes ..... E01F 15/0469 248/345.1
6,311,957 B1 * 11/2001 Driscoll ..... E04F 11/1812 256/65.05
6,618,953 B2 * 9/2003 Izumi ..... E04F 11/1812 33/521
6,736,373 B2 5/2004 Greaves
6,758,460 B1 7/2004 Driscoll
7,082,735 B2 * 8/2006 Ramsey ..... E04F 11/1842 52/832
7,104,525 B2 * 9/2006 Ricci ..... E04H 12/2292 256/1

(Continued)

FOREIGN PATENT DOCUMENTS

CA 2 851 471 A1 2/2014
DE 20307316 U1 9/2003

(Continued)

OTHER PUBLICATIONS

U.S. Appl. No. 15/330,562, filed Oct. 11, 2016, Moeller—DWMEV-1 (Applicant's Prior Application, Noted on p. 2 of present application).

*Primary Examiner* — Matthew R McMahon
(74) *Attorney, Agent, or Firm* — James K. Poole, Esq.

(57) ABSTRACT

Improved decorative shoes for balusters that cover and conceal the attachment points of the balusters to the tread, floor, or rail surfaces and secure themselves in place without the need for mechanical fasteners or adhesives. The baluster shafts can be retained within central holes in the shoes by the use of compressive elastic means such as flexible sheets, rods, strips, O-rings or the like to produce an interference fit when the shaft is inserted in the holes. The shoes can be produced in both flat and angled versions.

20 Claims, 7 Drawing Sheets

(56) References Cited

U.S. PATENT DOCUMENTS

| | | | | |
|---|---|---|---|---|
| 7,470,091 | B2 * | 12/2008 | Scholl | E02D 27/42 405/229 |
| 7,503,732 | B2 | 3/2009 | Byrd | |
| 7,614,612 | B2 | 11/2009 | Edwards | |
| 7,621,080 | B2 * | 11/2009 | Stanfield | E04H 12/2292 52/170 |
| 7,841,154 | B2 * | 11/2010 | Auman | F16B 5/0008 52/848 |
| 7,909,311 | B2 | 3/2011 | Edwards | |
| 7,971,412 | B1 | 7/2011 | Lim | |
| 8,033,530 | B2 * | 10/2011 | Timothy | E04F 11/181 256/22 |
| 8,356,803 | B2 | 1/2013 | Truckner | |
| 8,418,335 | B2 | 4/2013 | Edwards | |
| 8,887,452 | B2 * | 11/2014 | Carhart | E04H 12/2292 52/169.14 |
| 8,936,233 | B1 * | 1/2015 | Sneith | E04F 11/1812 256/67 |
| 8,978,337 | B2 | 3/2015 | Edwards | |
| 9,169,651 | B1 * | 10/2015 | Wynne | E04F 11/1812 |
| 9,221,109 | B2 * | 12/2015 | Wiebe | B23B 51/0018 |
| 9,790,689 | B2 * | 10/2017 | Milanowski | E04F 11/1842 |
| 10,344,483 | B2 * | 7/2019 | Yu | E04F 11/1812 |
| 2004/0025452 | A1 | 2/2004 | McLean | |
| 2005/0278926 | A1 | 12/2005 | Moore | |
| 2010/0237309 | A1 | 9/2010 | Ferris | |
| 2011/0271481 | A1 | 1/2011 | Ma | |
| 2011/0147687 | A1 * | 6/2011 | Sgariglia | E04F 11/1814 256/65.02 |
| 2013/0020546 | A1 | 1/2013 | Truckner | |
| 2013/0287510 | A1 | 10/2013 | Wiebe | |
| 2014/0034889 | A1 | 2/2014 | Edwards | |
| 2014/0217347 | A1 | 8/2014 | Green | |
| 2014/0246639 | A1 | 9/2014 | Lee | |
| 2015/0211235 | A1 | 7/2015 | Sneith | |
| 2016/0145873 | A1 * | 5/2016 | Green | E04F 11/1812 52/832 |
| 2016/0319535 | A1 | 11/2016 | Allen | |
| 2020/0277793 | A1 * | 9/2020 | Calderone | E04F 11/1814 |

FOREIGN PATENT DOCUMENTS

| | | | | |
|---|---|---|---|---|
| DE | 10331925 | A1 | 2/2005 | |
| DE | 10331925 | A1 | 2/2005 | |
| EP | 1308583 | A1 * | 5/2003 | E04F 11/1834 |
| EP | 2 746 486 | A2 | 6/2014 | |
| FR | 2641557 | A1 * | 7/1990 | E01F 9/642 |
| FR | 2831576 | A1 * | 5/2003 | E04F 11/1814 |
| GB | 2 250 332 | A | 6/1992 | |
| GB | 2 44 193 | A | 4/2008 | |
| KR | 10-2014-0142832 | | 12/2014 | |
| KR | 101475374 | B1 | 12/2014 | |
| KR | 10-2015-0091858 | | 8/2015 | |
| KR | 101588681 | | 1/2016 | |

* cited by examiner

DECORATIVE SHOE FOR BALUSTERS

CROSS-REFERENCE TO RELATED APPLICATIONS

This application claims the benefit of Applicant's provisional application, U.S. Ser. No. 62/496,952, filed Nov. 3, 2016, for "IMPROVED DECORATIVE SHOE FOR BALUSTERS"

This application is not a result of federally sponsored research or development.

BACKGROUND OF THE INVENTION

1. Field of the Invention

The present invention relates to an improved decorative shoe that is used to cover and conceal the attachment points which secure a baluster between the tread, floor, or knee wall and the rail of a stairway.

2. Description of Relevant Art

Balusters provide a physical barrier to the passage of children and pets under the hand rails of open stairways and balconies and thus prevent dangerous falls. In addition to their utilitarian value, they also contribute to the aesthetics of the stairway or balcony and are offered in a variety of decorative designs and are manufactured from wood, solid metal bars, hollow metal tubes and other materials.

Metal balusters, hollow or solid, are typically installed by drilling a 0.5 to 0.625 inch diameter hole into the underside of the rail which matches the upper end of the baluster, which is typically cylindrical in shape and 0.5 or 0.625 inch in diameter. The lower end of the baluster is not fitted with a pin and can't be nailed, so a hole of 0.75 or 1.0 inch in diameter is drilled into the upper face of the stair tread, floor or knee wall. The baluster is then cut to a length that is 0.5" to 0.75" greater than the distance between the bottom of the rail and the face of the tread. The base of the baluster is inserted into the hole in the tread, then pivoted and the top of the baluster is elevated and inserted into the hole in the underside of the rail. The baluster is then held in place and a commercial adhesive or epoxy is prepared and poured or injected into the hole in the tread. The baluster is then held in place until the adhesive or epoxy has dried or cured. Although this application does not claim benefit or priority from same, Applicant's previous applications, provisional application U.S. Ser. No. 62/284,920, filed Oct. 13, 2015 for "METAL BALUSTER INSTALLATION SYSTEM", and a utility application, U.S. Ser. No. 15/330,562, filed Oct. 11, 2016 for "HOLLOW BALUSTER INSTALLATION SYSTEM", describe preferred methods for the installation of balusters as new or replacement systems.

As the attachment point at the bottom of the baluster is roughly drilled and contains cured epoxy, it would detract from the aesthetic appearance of the stairway so decorative covers known as shoes are used to conceal and hide the base attachment point of the baluster and/or conceal the top attachment point of the baluster to the underside of the rail.

These decorative shoes are commercially available and are typically made from cast zinc or other pot metal, then painted or otherwise finished to match the color and texture of the finish applied to the balusters. Shoes are made in two basic styles: flat for use where the baluster is perpendicular to the surface it is intersecting (e.g., a tread) and angle or rake where the baluster is intersecting the surface at an angle (e.g., the underside of the rail). Shoes are typically made in a shape that is, in simplistic terms, a truncated pyramid or cone with an open base sized so that it is large enough to fully cover and conceal the mounting of the baluster in the tread, floor, knee wall or underside of the rail. From the open base of the shoe, the solid sides typically rise up in a series of flat and curved shapes to achieve the desired decorative appearance and then taper to a reduced size at the top where the baluster exits the shoe. The top is made to include a hole that is shaped to match the cross section of the baluster and is slightly oversized so that it clears and can slide over the baluster readily. The shoe is typically fitted with a set screw or other similar mechanical fastener that is tightened, as the shoe is held in place, to secure it in its final location.

There are several known problems with the existing shoes. One problem is the mechanical securing system currently used to hold the existing shoe in place. The existing system uses the tightening of a set screw mounted in the side of the shoe to press and pinch the shaft of the metal baluster between the tip of the set screw and the opposite internal side of the passage through the shoe which the metal baluster passes through. Shortcomings of this method include damaged set screws or threads so that the set screw will not tighten; the pressing of the shaft against one side of the hole in the shoe results in the shoe sitting off center relative to the baluster shaft, and the act of tightening brings metal tools into contact with the finished faces of the shoe which can chip or damage the finish of the shoe.

A second problem is the existing shoes are fitted with an internal passage for the baluster shaft that must be sized to allow for clearance around the baluster shaft. As the shoes are often molded, the internal passage usually has a slight draft angle designed into it to facilitate its removal from the mold. When present, this draft angle results in the sides of the passage being not parallel to the sides of the baluster shaft, so that when the set screw is tightened the shoe will tilt slightly and not sit in alignment with the baluster shaft. This results in the shoes not sitting flat and in full contact with the surface of the tread, floor, knee wall or underside of the rail. As such, these misalignments detract from the aesthetic appearance of the stairway.

A third problem with the current shoes is that the metal tips of the setscrews and sides of the internal passage are hard and may not be smooth, and thus can cause damage to the decorative finish on the baluster shaft when the shoe is slid over the shaft prior to installation of the baluster into the stairway. The shoe needs to remain elevated on the baluster shaft while the base of the baluster is held and secured in place, so the setscrew must be temporarily tightened or a spring clamp or other similar device used to hold the shoe in the elevated position. The act of holding the shoe in this elevated position creates additional opportunity and risk for the decorative surface of the baluster to be damaged.

Finally, the angle or rake shoes are produced at a fixed angle. The permitted range of stairway slope, rise to run, is set by local building codes, varies from state to state and has changed over time. Therefore, there is no single standard slope that can be used in the design of the existing angle or rake shoes. As such, these shoes are manufactured with an angle that is at the estimated maximum or steepest slope that is expected to be encountered. By producing them to match the steepest likely slope, the shoe can be modified by the installer, by sanding or filing down the longest face and the two sides, to reduce the angle to the point that it matches the actual stair slope. The modification of the angle of the shoe requires proper tools and skill to get the shoe to align properly and even a skilled installer can damage the shoes so that they have to be discarded. For a do-it-yourself installer that either doesn't know that sanding or filing of the angle is required for good fit and finish or is unable to do the modification, there is a high likelihood that when the set screw is tightened there will be a clear misalignment between the angle or rake shoe and the underside of the rail. As a result, there will be a visible gap between one or more of the edges of the shoe base and the underside of the rail which will detract from the overall appearance of the stairway.

Prior art such as Truckner's U.S. Pat. No. 8,356,803 B2 and US 2013/0020546 A1 describe an integrated shoe and attachment system the includes a ball and socket joint to provide for adjustment of the shoe to the slope of the rail or knee wall. While this system addresses the problem with the alignment of the base of the shoe and the underside of the rail and securing it in place, the solution provided is complex, as it requires multiple custom made components and fasteners be used and in some cases significant machining of the rail must be accomplished to facilitate installation.

Prior art such as Wynne's U.S. Pat. No. 9,169,651 B1 describes another integrated shoe and attachment system that includes a pivoting joint to provide for adjustment of the shoe to the slope of the rail or knee wall. While this system also address the problem with the alignment of the base of the shoe and the underside of the rail and securing it in place, the solution provided is also complex, since it requires multiple custom made components and fasteners be used to facilitate installation.

Prior art such as Timothy's U.S. Pat. No. 8,033,530 B2 describes the use of a baluster fastening system with a mounting base that is designed to have an appearance that is similar to the existing decorative shoes. While this addresses many of the shortcomings of the current shoes, it requires that the described attachment system be used and as such prevents it being utilized with the traditional installation methodology which may be preferred due to its proven durability and design flexibility.

Prior art such as Wiebe's US 2013/0287510 A1 describes the use of a baluster fastening system that includes covers similar in appearance to the existing decorative shoes. These covers mechanically fasten to portions of the described fastening system without the use of set screws in the covers. While this allows for the covers to be secured without the need for set screws, it requires that the described attachment system be used and as such prevents it being utilized with the traditional installation methodology which may be preferred due to its proven durability and design flexibility.

In view of the foregoing disadvantages and limitations found in the prior art of decorative shoes to cover and conceal the mounting points of metal balusters, there is an interest in and need for improved decorative shoes.

SUMMARY

An improvement is provided to the typical ornamental "shoes" or covers which are used to cover the junctures between balusters and the surfaces to which the balusters are connected by replacing the typical mechanical fasteners, such as setscrews, which are used to hold the shoes in place after installation by assembling the shoes from two sections, namely a base or bottom section and a second, top or upper section.

The base section has a surface which is adapted to align and create a close fit to the surface of a stair rail, a floor or stair tread or a knee wall. The base section surface can be "flat," perpendicular to the longitudinal axis of the baluster, or can be "angled" or "raked" for use with stair rails or knee wall. In the case of angle or rake shoe, the surface is oriented at an acute angle with respect to the longitudinal axis of the baluster which corresponds approximately to the angle between the stair railing and the vertical. The portion of the base section adjacent to the surface of a stair rail, stair tread or the like contains an internal opening large enough to cover and conceal the juncture, and a hole at the opposite end having dimensions and shape large enough to allow a baluster shaft to pass through.

A second, top or upper section of the shoe is adapted to be joined to the surface of the base section opposite its contact with the surface of a stair rail, stair tread or the like, thus forming a complete shoe. This section has a hole at the end opposite its joinder to the base section, the hole also having dimensions and shape large enough to allow the passage of a baluster shaft.

Before joining the two sections of a shoe, compressive elastic means are installed in the base section, surrounding the hole at the end opposite the surface which is to contact the surface of the stair rail or stair tread. Various embodiments of such means can be employed, with the objective of providing an opening around the hole which is smaller than the width of the baluster shaft, allowing the compressive elastic means to provide an interference fit as the baluster shaft is inserted. By an interference fit it is meant that the elastic materials, whatever form they may take, provide lateral forces on the shaft which tend to keep it in position.

Once the compressive elastic means (such as described below) are installed, the two sections of the shoe can be joined, forming an integral article. The sections can be joined in a removably attachable manner, as with a pressure sensitive adhesive, if it may be necessary to separate them for repair or replacement of the compressive elastic means, or they may be permanently joined. In either case, mechanical features such as interlocking ridges and grooves, pins and holes or the like can be molded into the two sections to make their joinder stronger and more stable.

In one embodiment, a decorative shoe is produced by the casting or molding of specially designed upper and lower shoe sections. The upper and lower shoe sections can be made from zinc, pot metal or other castable metal, thermoplastic, thermoset or other moldable polymers, or other materials that can be cast or molded. Into the lower shoe section a thin sheet of flexible and compressible material, such as rubber, EPDM (a terpolymer made from ethylene-propylene diene monomer), thermoplastic elastomer (TPE) or other similar material, with a shaped hole in it is mounted. Such materials are preferably selected from those which are resistant to oxidation or deterioration over time. The upper shoe section is then attached to the lower shoe section using glue, ultrasonic welding, fasteners or other methodology so that it secures and holds the sheet in place and results in a single finished decorative shoe being produced. The decorative shoe can then be painted or otherwise finished, if required, so that it has the desired color, gloss and/or texture. The hole in the sheet is smaller than the cross section of the baluster so that when the baluster is inserted into the shoe the sheet must stretch around the shaft of the baluster. This produces an interference fit and a moderate amount of force is needed to slide the shoe over the baluster. As a result when the shoe is slid into its final alignment and position it remains there without need of mechanical fasteners, glue or other devices.

In a second embodiment, an improved decorative shoe is produced by the casting or molding specially designed upper and lower shoe sections. The upper and lower shoe sections can be made from zinc, pot metal or other castable metal, thermoplastic, thermoset or other moldable polymers, or other materials that can be cast or molded. Into the lower shoe section a pair of rods or strips of flexible and compressible material, such as rubber, EPDM, TPE or other similar material, are mounted transversely on opposite interior sides of the internal opening through the shoe. These rods or strips can be round, square, or rectangular in cross section, may be solid or hollow and are longer than the width of the baluster. The upper shoe section is then attached to the lower shoe section using glue, ultrasonic welding, fasteners or other methodology so that it secures and holds the two rods or strips in place and results in a single finished decorative shoe being produced. The decorative shoe can then be painted or otherwise finished, if required, so that it has the desired color, gloss and/or texture. The gap between the two rods or strips is smaller than the cross section of the baluster so that when the baluster is inserted into the shoe the two rods or strips must be compressed for the shaft of the baluster to pass between them. This produces an interference fit and a moderate amount of force is needed to slide the shoe over the baluster. As a result when the shoe is slid into its final alignment and position it remains there without need of mechanical fasteners, glue or other devices.

In a third embodiment, an improved decorative shoe is produced by the casting or molding specially designed upper and lower shoe sections. The upper and lower shoe sections can be made from zinc, pot metal or other cast able metal, thermoplastic, thermoset or other moldable polymer, or other materials that can be cast or molded. Into the lower shoe section an O-ring of flexible, elastic and compressible material, such as rubber, EPDM, TPE, Buna rubber or other similar material, is mounted in the internal opening in the upper face of the lower portion of the shoe. The O-ring can be round, square, or rectangular in cross section, and may be solid or hollow. The upper shoe section is then attached to the lower shoe section using glue, ultrasonic welding, fasteners or other methodology so that it secures and holds two opposite sections of the O-ring and pulls it into an oval shape, thus resulting in a single finished decorative shoe. The decorative shoe can then be painted or otherwise finished, if required, so that it has the desired color, gloss and/or texture. The gap between the two sides of the O-ring is smaller than the width of the baluster so that when the baluster is inserted into the shoe the O-ring must be stretched for the shaft of the baluster to pass through it. This produces an interference fit and a moderate amount of force is needed to slide the shoe over the baluster. As a result when the shoe is slid into its final alignment and position it remains there without need of mechanical fasteners, glue or other devices. In a preferred embodiment, ridges or cleats are provided on the surface of the base section of the shoe, arranged and adapted to secure the two ends of the O-ring in a stretched position to produce the desired interference fit for the baluster shaft.

In each of the three embodiments, the flexible and compressible sheet, rod or O-ring bridges the gap between the sides of the baluster shaft and the decorative shoe and allows the sheet, rod or O-ring to softly but firmly grip the sides of the baluster shaft. The gripping of the shoe to the baluster shaft in this way allows for it to remain in place without the need for setscrews or other mechanical fasteners that can fail. The gripping of the shoe to the baluster shaft also allows the shoe to hold in place across a range of angles to the baluster shaft so that the base of the decorative shoe will align and sit flush to the floor, tread, knee wall or underside of the rail. The bridging of the gap allows the size of the internal passage to be larger with additional clearance so that the faces of the baluster are not contacted or damaged by the shoe as it is slid over the baluster shaft. As a result the known deficiencies of the current commercially available decorative shoes are addressed and overcome.

These improved shoes are manufactured by providing base and upper sections for the shoe, installing the elastic compressive means as appropriate for their structures, then joining the upper and base sections temporarily or permanently by means discussed above. Installing balusters with decorative shoes is easier with the improved shoes, since the shoes can be positioned on the baluster shaft some distance from the point which will be attached to the appropriate surface of a floor, tread, knee wall or underside of a stair rail, then slid down and/or up the shaft and held in the installed position(s) to cover the point(s) at which the balusters are attached to such surfaces.

BRIEF DESCRIPTION OF THE DRAWINGS

The invention will be better understood and aspects other than those set forth above will become apparent when consideration is given to the following detailed description and drawings. The same numerals are used to designate like components in these figures. Such description makes reference to the annexed drawing wherein.

DETAILED DESCRIPTION OF PREFERRED EMBODIMENTS

In general, the following description adopts a terrestrial frame of reference, in which the bottom of a component is considered to be the side nearest the floor or earth when in normal use, and the top being the side opposite and facing upward. However, as the articles described below and known as decorative "shoes" can be used with such a bottom surface facing upward, alternative terms may be used, such as a base section and a second section connected thereto, since the articles comprise two separate sections which are fitted together to create a complete shoe unit. While the shoes known as "decorative" in the industry may be attractive or aesthetically pleasing, their essential function is to conceal the junctions between the baluster shafts and stairs, floors, etc. The term "and/or" is used in the conventional sense, in which "A and/or B" indicates that A or B, or both, may be present.

Figure 1:
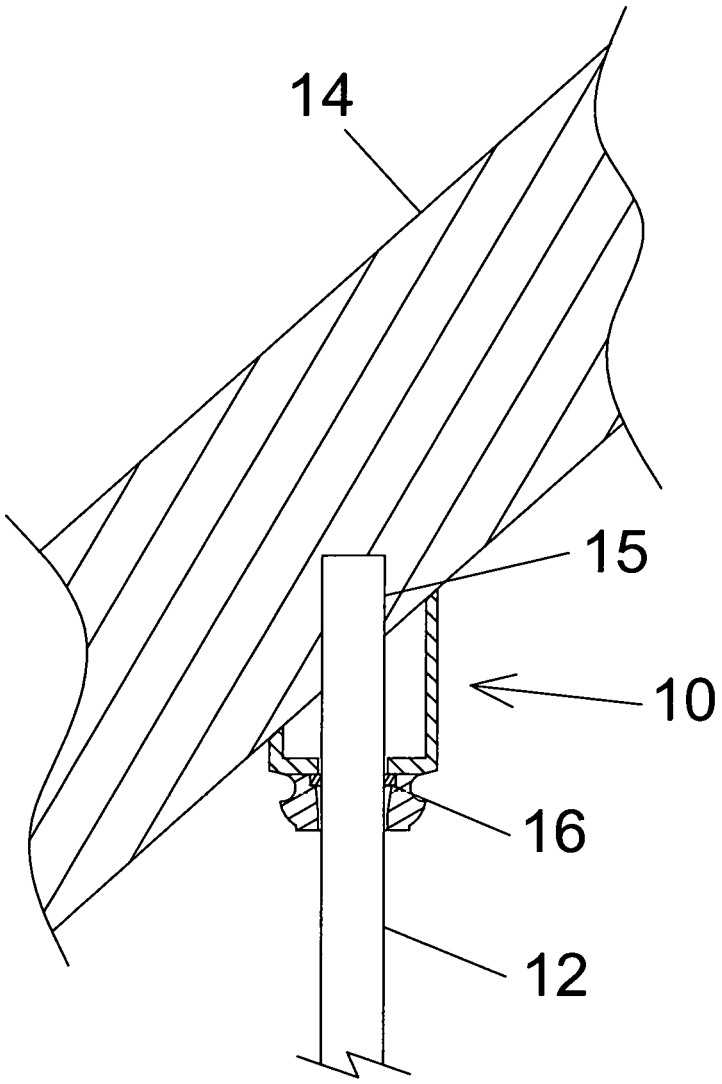
FIG. 1 shows the cross section side view of a decorative angle or rake shoe, using the thin flexible and compressible sheet 16, installed to cover the mounting point of a baluster into the underside of the rail.

With reference to FIG. 1, a rail (14) is shown with a baluster (12) mounted into a drilled hole (15) in the underside of the rail (14). The intersection of the rail (14) and baluster (12) is hidden by the decorative angle or rake shoe (10) that is held in place against the bottom of the rail (14) by the pressing of the edges of the thin, flexible and compressible sheet (16) against the exterior faces of the baluster (12).

Figure 2B:
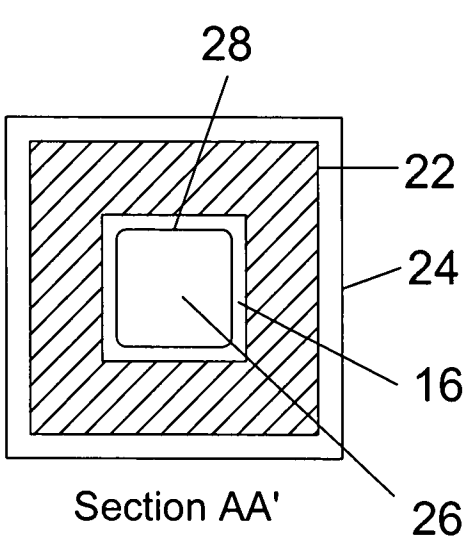
FIGS. 2A and 2B show cross section side and top views of a decorative flat shoe fitted with the thin flexible and compressible sheet.
Figure 2A:
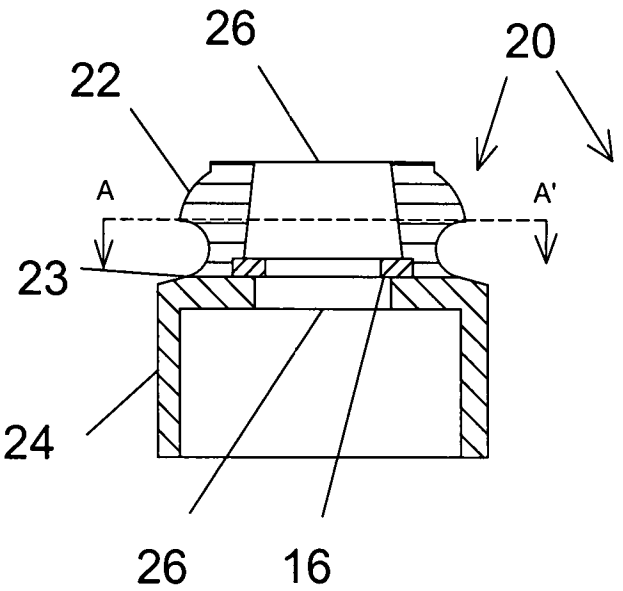

With reference to FIG. 2A, a decorative flat shoe (20) is produced by the attachment of the upper flat shoe section (22) to the lower flat shoe section (24) which results in a fine flat shoe upper and lower section mating line (23) being created. The connection of the two shoe sections captures and secures in place the thin, flexible and compressible sheet (16) that will hold the decorative flat shoe (20) in position on the baluster (not shown) when the baluster (not shown) is inserted and passes through the flat shoe opening (26). With reference to FIG. 2B, the shaped opening (28) that has been punched or cut into the thin flexible and compressible sheet (16) is shown. The circumference of the shaped opening (28) is less than the external perimeter of the baluster shaft (not shown) so that when the decorative flat shoe (20) is placed over the baluster (not shown) the desired interference fit and grip to the exterior of the baluster shaft (not shown) is achieved. The shaped opening (28) in the sheet (16) is also smaller than the flat shoe opening (26) which is sized to allow for clearance around the baluster shaft (not shown). Having this clearance allows for the shoe to tilt slightly, if needed, to have the base of the decorative flat shoe (20) sit flush and tight to the upper face of a tread or floor surface (not shown) or the underside of a horizontal rail (not shown).

Figures 3A, 3B:
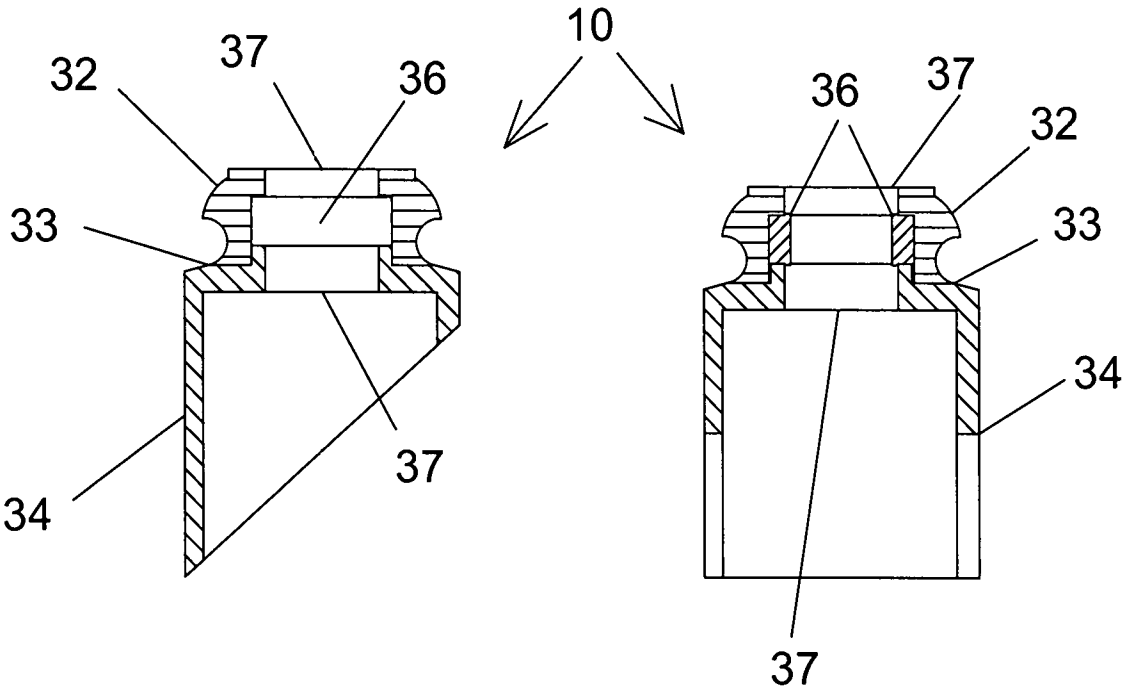
FIGS. 3A and 3B show two cross section side views of a decorative angle or rake shoe fitted with the flexible and compressible rod or strip.

With reference to FIGS. 3A and 3B, a decorative angle or rake shoe (10) is produced by the attachment of the upper shoe section (32) to the lower shoe section (34) which results in a fine upper section and lower section mating line (33) being created. Surfaces of the angled portions of the lower shoe section (34) which were not sectioned can be seen at the bottom of FIG. 3B. The connection of the two shoe sections captures and secures two flexible and compressible rods or strips (36) in place. The gap between the two flexible and compressible rods or strips (36) is less than the width of the baluster shaft (not shown) so that when the decorative angle shoe (10) is placed over the baluster (not shown) the desired interference fit and grip to the sides of the baluster shaft (not shown) is achieved. Openings (37) are provided in both upper and lower shoe sections for entry of the baluster shafts.

Figure 4B:
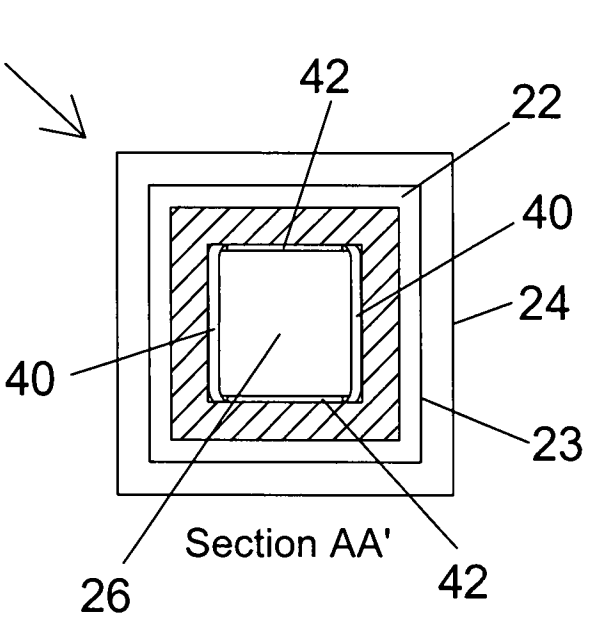
FIGS. 4A and 4B show cross section side and top views of a decorative flat shoe fitted with the flexible, elastic and compressible O-ring.
Figure 4A:
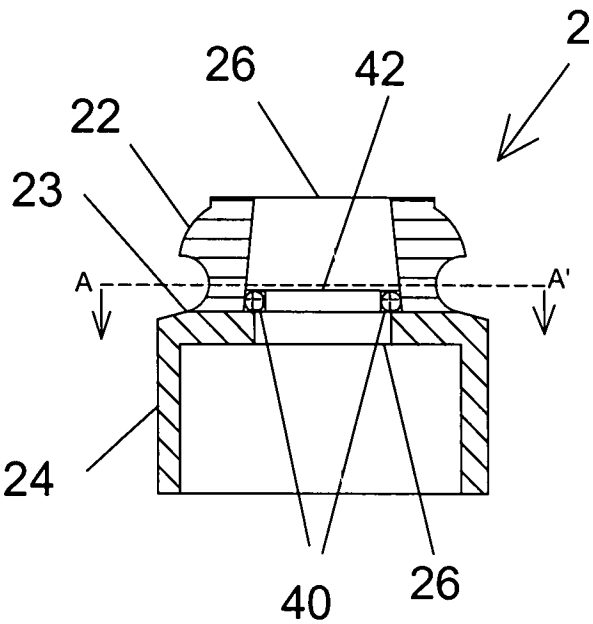

With reference to FIGS. 4A and 4B, a decorative flat shoe (20) is produced by the attachment of the upper shoe section (22) to the lower shoe section (24) which results in a fine upper section and lower section mating line (23) being created. Two ends of the flexible, elastic and compressible O-ring (40) are held by a pair of mounting cleats (42) that have a height that allows them to both hold the flexible, elastic and compressible O-ring (40) and to come almost in contact with the lower face of the upper shoe section (22) so as to prevent the flexible, elastic and compressible O-ring from sliding off the mounting cleats (42). The result is the connection of the two shoe sections, (22) and (24), captures and secures the flexible, elastic and compressible O-ring (40) in place. The gap between the two unsecured sides of the flexible, elastic and compressible O-ring (40) is less than the width of the baluster shaft (not shown) so that when the decorative flat shoe (20) is placed over the baluster (not shown) the desired interference fit and grip to the sides of the baluster shaft (not shown) is achieved.

Figure 5:
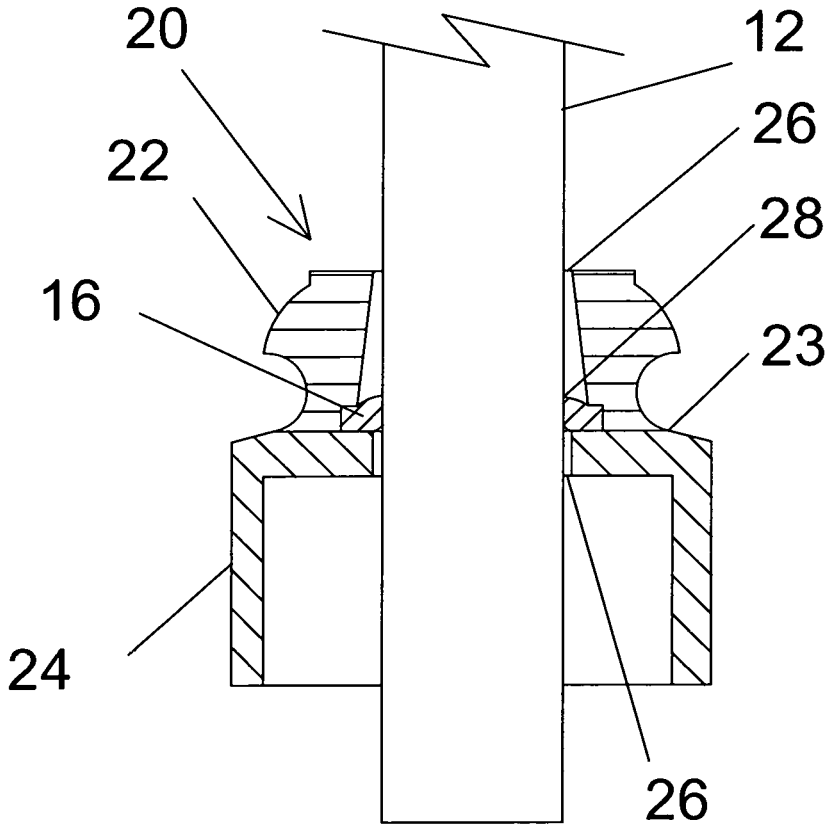
FIG. 5 shows a cross section side view of a decorative flat shoe with the thin flexible and compressible sheet 16 installed on a baluster.

With reference to FIG. 5, a decorative flat shoe (20) is produced by the attachment of the upper shoe section (22) to the lower shoe section (24) which results in a fine upper section and lower section mating line (23) being created. The shaft of the baluster (12) is shown passing through the flat shoe openings (26). The thin, flexible and compressible sheet (16) is shown held in place by the joining of the upper shoe section (22) and lower shoe section (24). The shaped opening (28) in the sheet (26) is smaller than the perimeter of the baluster (12) which results in the compressing of the sheet between the sides of the baluster (12) and the interior sides of the shoe opening (26). This compression causes the shoe (20) to grip the baluster (12) firmly enough to that it prevents the shoe (20) from moving on the baluster (12) due to its own weight but not so tightly that the shoe (20) can't be manually moved to its desired location on the baluster (12).

Figure 6:
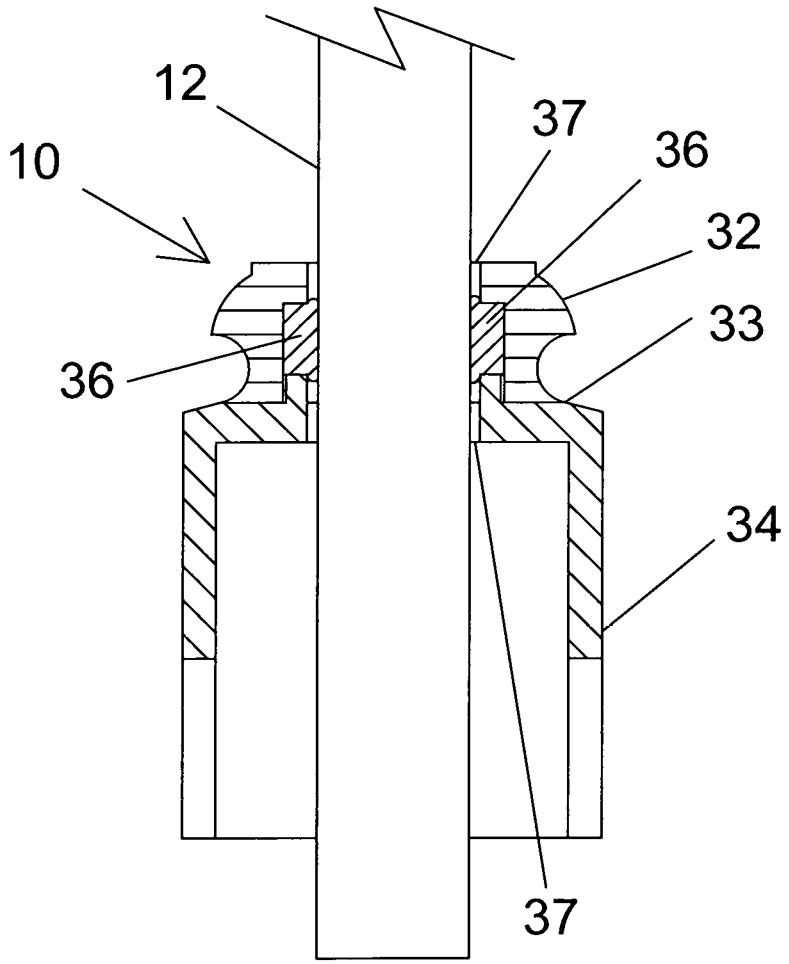
FIG. 6 shows a cross section side view of a decorative angle or rake shoe with the flexible and compressible rod or strip installed on a baluster.

With reference to FIG. 6, a decorative angle or rake shoe (10) is produced by the attachment of the upper shoe section (32) to the lower shoe section (34) which results in a fine upper section and lower section mating line (33) being created. Portions of the angled surface of the lower shoe section (34) which were not included in the cross section can be seen at the bottom of the figure. The shaft of the baluster (12) is shown passing through the angle shoe openings (37). The flexible and compressible rods or strips (36) are shown held in place by the joining of the upper shoe section (32) and lower shoe section (34). The gap between the two flexible and compressible rods or strips (36) is smaller than the width of the baluster (12), which results in the compressing of the rods or strips between the sides of the baluster (12) and the interior sides of the shoe openings (37). This compression causes the shoe (10) to grip the baluster (12) firmly enough to that it prevents the shoe (10) from moving on the baluster (12) due to its own weight but not so tightly that the shoe (10) can't be manually moved to its desired location on the baluster (12).

Figure 7:
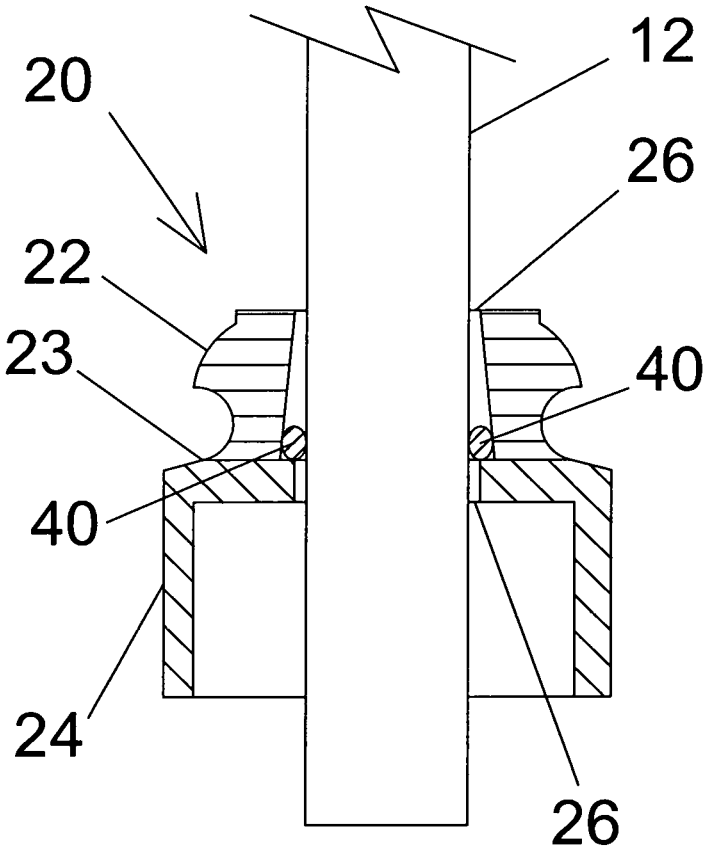
FIG. 7 shows a cross section side view of a decorative flat shoe with the flexible, elastic and compressible O-ring installed on a baluster.

With reference to FIG. 7, a decorative flat shoe (20) is produced by the attachment of the upper shoe section (22) to the lower shoe section (24), which results in a fine upper section and lower section mating line (23) being created. The shaft of the baluster (12) is shown passing through the flat shoe openings (26). The flexible, elastic and compressible O-ring (40) is shown held in place on the mounting cleats (not shown) by the joining of the upper shoe section (22) and lower shoe section (24). The space between the inner edges of the O-ring (40) is less than the width of the baluster (12) shaft, which results in the compressing of the O-ring (40) between the sides of the baluster (12) and the interior sides of the shoe opening (26). This compression causes the shoe (20) to grip the baluster (12) firmly enough to that it prevents the shoe (20) from moving on the baluster (12) due to its own weight but not so tightly that the shoe (20) can't be manually moved to its desired location on the baluster (12).

EXAMPLE

Three prototypes of the flat improved decorative shoe shown in FIG. 7 were produced and fitted with commercially available Buna rubber O-rings. The Buna O-rings were 0.125" in cross section diameter and were in sizes 113, 114 and 115, respectively. Each of the flat shoes had an iron baluster inserted into them and then a spring scale was used to measure (in grams) the force required to get the shoe to start sliding in each direction on the baluster. To measure the ability to retain their grip, the shoes were then slid 5.5" in each direction every 3 minutes for a period of 90 minutes. At the end of the test the force required to get the shoe to slide was again measured with a spring scale. The results were as follows:

Size 113: Initial Up—850 gr/Down—600 gr Final Up—800 gr/Down—500 gr

Size 114: Initial Up—1300 gr/Down—900 gr Final Up—1100 gr/Down—900 gr

Size 115: Initial Up—850 gr/Down—700 gr Final Up—800 gr/Down—750 gr

These data indicate that shoes of this design with rubber O-rings of suitable sizes will perform as intended in installation and service, as described above. In the foregoing description, certain terms have been used for brevity, clarity and understanding. All equivalent relationships to those illustrated in the drawings and described in the preferred embodiment are to be encompassed by this present invention to produce the intended results. It is also to be understood that the following claims are intended to cover all of the generic and specific features of the invention herein described, and all statements of the scope of the invention which, as a matter of language, might be said to fall therebetween.

Having thus described and disclosed preferred embodiment of my invention, what I claim as my invention is:

1. A decorative shoe article for balusters, adapted to cover the juncture of a baluster with the underside of a stair rail and/or upper surface of a floor or stair step or a knee wall, comprising:

a) a base section having a first surface adapted to align and be in contact with the underside of the stair rail and/or the upper surface of the floor or stair step or knee wall, wherein the first surface of said base section comprises an opening large enough to cover and conceal the juncture of a baluster shaft with the surface of the stair rail, stair step, floor or knee wall without contacting said juncture, and an opposite second surface of said base section comprises a longitudinal hole having dimensions and shape effective to accommodate said baluster shaft, b) a second section of said shoe article, separate from the base section, adapted to be attached to the second surface of said base section, comprising a longitudinal hole which will align with the hole in said base section to accommodate said baluster shaft, and c) said base section incorporates, in a portion opposite said first surface, compressive elastic means which provide a hole configured to be narrower than the dimensions of said baluster shaft to provide an interference fit when the baluster shaft is inserted through the holes in the combined sections of said shoe article, said compressive elastic means providing sufficient force on said baluster shaft to hold said shoe article in position both during and after installation, wherein said base section and said second section are joined together to form the completed shoe article, and wherein the combined sections of said shoe article are configured to slide together along the length of said baluster shaft.

2. The shoe article of claim 1 wherein said first surface is substantially perpendicular to the longitudinal axis of said base section.

3. The shoe article of claim 1 wherein said first surface forms an acute angle with respect to the longitudinal axis of said base section.

4. The shoe article of claim 1 wherein said base section and said second section are joined together in at least a temporary manner.

5. The shoe article of claim 4 wherein said base section and said second section are joined together permanently.

6. The shoe article of claim 4 wherein said base section and said second section comprise physical features to facilitate their being joined together in a secure manner.

7. The shoe article of claim 1 wherein said compressive elastic means comprise a sheet of elastic material affixed to the first surface of said base section, said sheet comprising a central hole having dimensions and shape effective to provide an interference fit when the baluster shaft is inserted therein.

8. The shoe article of claim 1 wherein said compressive elastic means comprise at least a pair of rods and/or strips of compressible material which are mounted and attached laterally on opposite interior sides of the opening in the first surface of said base section, wherein the spacing and arrangement of said rods or strips provide an interference fit for the baluster shaft which is inserted therein.

9. The shoe article of claim 1 wherein said compressive elastic means comprise at least one elastic O-ring which is stretched over two ridges provided on opposite sides of the first surface of said base section which includes said opening, wherein said O-ring is arranged in a manner which provides an interference fit for the baluster shaft which is inserted therein.

10. The shoe article of claim 1 wherein said compressive elastic means are formed from elastic materials selected from the group consisting of rubbers and thermoplastic elastomers which are resistant to oxidation and/or deterioration.

11. The decorative shoe article for balusters of claim 1, wherein said compressive elastic means provide sufficient force on said baluster shaft to hold said shoe article in place without external fasteners.

12. A method of manufacturing decorative shoe articles according to claim 1 for covering junctures between balusters and surfaces to which they are to be attached, comprising steps of:

a) providing the base section with the first surface to be installed adjacent to a surface, comprising an internal opening large enough to cover and conceal the juncture of a baluster with such a surface, and a hole in the opposite second surface having dimensions and shape large enough to accommodate the baluster shaft;

b) installing the compressive elastic means on said opposite surface surrounding said hole in said opposite second surface in a manner adapted to provide an interference fit for the baluster shaft inserted in said hole;

c) providing the second section adapted to be joined to said opposite second surface of said base section and having a hole in the surface opposite the joinder area which has dimensions and shape large enough to allow the baluster shaft to enter; then d) fastening said second section to said base section to form a complete shoe article.

13. The method of claim 12 wherein said compressive elastic means installed on said opposite surface of said base section comprise a thin sheet of flexible and compressible material.

14. The method of claim 12 wherein said compressive elastic means comprise at least one pair of rods or strips of flexible and compressible material which are installed transversely on opposite interior sides of the internal opening through said base section of said shoe article.

15. The method of claim 14 wherein said interference fit is effective to retain said at least one shoe article in place on the baluster shaft during the installation process without external fasteners.

16. The method of claim 14 wherein said shoe articles are flat or angled shoes.

17. The method of claim 12 wherein said compressive elastic means comprise at least one O-ring fastened to said base section of said shoe article and arranged and adapted to stretch when the baluster shaft is inserted through said base section of said shoe article.

18. The method of claim 17 wherein said O-ring is stretched over two ridges on opposite sides of the first surface of said base section which includes said internal opening.

19. A method of installing balusters between a stair rail and a floor, knee wall or stair treads, the improvement comprising the use of at least one decorative shoe article according to claim 1 for covering the junctures between said balusters and the surfaces of said stair rail, floor, knee wall or stair treads, wherein each said shoe article comprises compressive elastic means installed internally which provide an interference fit for baluster shafts inserted therein and are effective to retain said shoe article in place once installed.

20. In a decorative shoe article for balusters adapted to cover the juncture of a baluster with the underside of a stair rail and/or upper surface of a floor or stair step or a knee wall, the improvements comprising:

a) a base section having a first surface adapted to align and be in contact with the underside of the stair rail and/or the upper surface of the floor or stair step or knee wall, and the first surface of said base section comprises an opening large enough to cover and conceal the juncture of a baluster shaft with the surface of the stair rail, stair step, floor or knee wall, and an opposite second surface of said base section comprises a longitudinal hole having dimensions and shape effective to accommodate said bluster shaft, and b) a second section of said shoe article, separate from the base section, adapted to be attached to the second surface of said base section, comprising a longitudinal hole which will align with said hole in said base section to accommodate said baluster shaft, wherein c) said base section incorporates, in a portion opposite said first surface, compressive elastic means which provide a hole configured to be narrower than the dimensions of said baluster shaft to provide an interference fit when said baluster shaft is inserted through the holes in the combined sections of said shoe article, with said compressive elastic means providing sufficient force on said baluster shaft to hold said shoe article in position both during and after installation without external fasteners, and wherein the combined sections of said shoe article are configured to slide together along the length of said baluster shaft.

* * * * *